United States Patent [19]

Szczepanski

[11] 4,020,978

[45] May 3, 1977

[54] MANUALLY-OPERATED DISPENSER

[76] Inventor: Harry Szczepanski, 900 Clancy NE., Grand Rapids, Mich. 49505

[22] Filed: Aug. 15, 1975

[21] Appl. No.: 605,185

[52] U.S. Cl. ..... 222/209

[51] Int. Cl.[2] ..... B65D 37/00

[58] Field of Search ..... 222/92, 94, 103, 209, 222/212, 213, 401, 402, 215, 145, 389

[56] References Cited

UNITED STATES PATENTS

| | | | |
|---|---|---|---|
| 2,715,980 | 8/1955 | Frick | 222/212 X |
| 2,743,038 | 4/1956 | Ferries | 222/209 X |
| 3,124,174 | 3/1964 | Seuthe | 222/209 X |
| 3,179,300 | 4/1965 | Davidson et al. | 222/213 |
| 3,223,289 | 12/1965 | Bouet | 222/209 X |
| 3,319,837 | 5/1967 | Mueller | 222/212 X |
| 3,814,287 | 6/1974 | Darbon et al. | 222/94 |
| 3,876,111 | 4/1975 | Swain | 222/94 |

*Primary Examiner*—Stanley H. Tollberg
*Assistant Examiner*—Norman L. Stack, Jr.
*Attorney, Agent, or Firm*—Glenn B. Morse

[57] ABSTRACT

A dispenser for flowable materials has an outer housing surrounding a readily deformable inner container holding the material to be dispensed. The housing is resiliently deformable under manually applied forces, and has an air inlet covered by the hand of the user, or controlled by a check-valve providing for inflow exclusively. Constriction or compression of the housing by hand increases the pressure of the air occupying the space between the housing and the inner container, compressing the inner container, and expelling some of the contents via an outlet. Release of gripping pressure permits the resiliency of the housing to restore its original configuration, and produces a suction causing inflow of air at the air inlet in a volume corresponding to the volume of the discharged contents of the inner container. A modification of the invention utilizes the air pressure to additionally produce one or more jets of air at the outlet to increase atomization. The inner container and the outer housing are both preferably tubular, and have a common seal at the end of the device opposite from the outlet.

4 Claims, 24 Drawing Figures

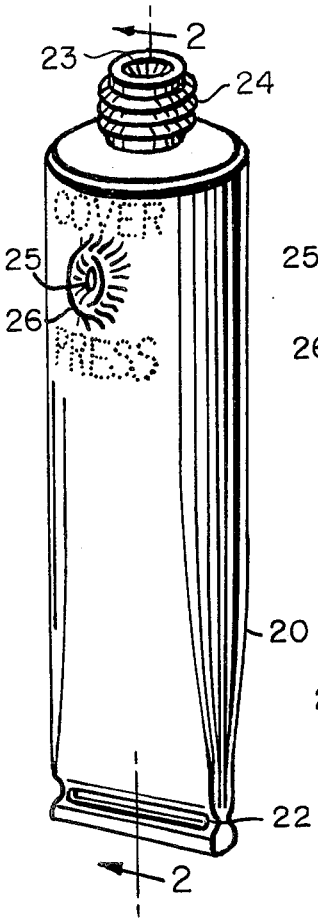
Fig. 1
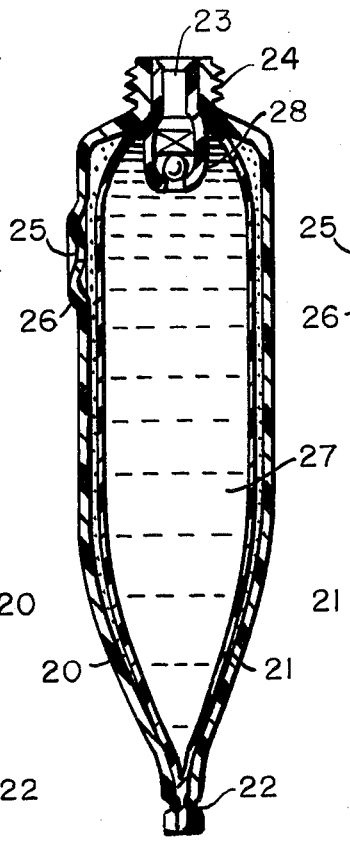
Fig. 2
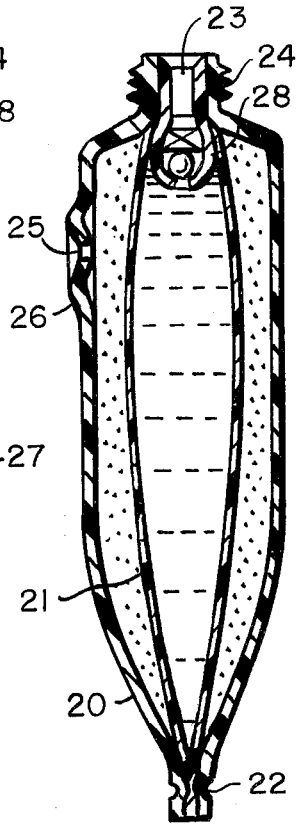
Fig. 3
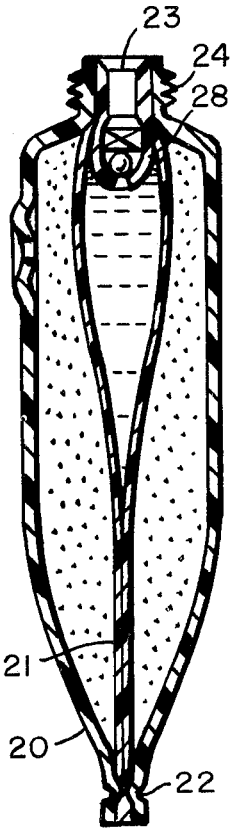
Fig. 4
Fig. 5
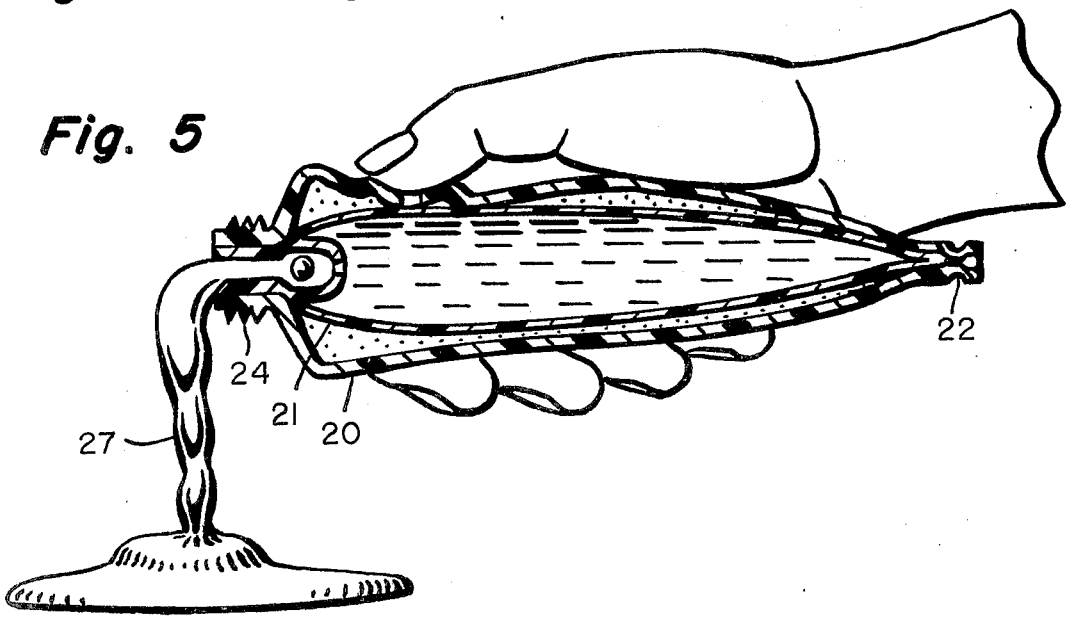

MANUALLY-OPERATED DISPENSER

BACKGROUND OF THE INVENTION

It has been common practice to package low-viscosity liquids in pressure containers along with a propellant gas that ejects the contained liquid in a fine spray when a discharge valve is opened. This type of device, while used in tremendous quantities, has fallen into disfavor for two reasons:

a. The cost of the propellant gas, and the necessary space occupied by it in the container, and b. the adverse ecological effects of the propellant gas (freon) most commonly used. Objections to the aerosol-type device have resulted in increased use of dispensers functioning in the manner of a small pump, usually actuated by finger-pressure, and operating directly on the liquid within the container. The pump and the aerosol systems are both limited to handling low-viscosity liquids.

A modification of the aerosol container has been proposed, which adds an inner readily deformable container for the liquid to be dispensed, and admits the gas pressure exclusively in the space between the inner and outer containers. This arrangement is really no answer to the problem, as the space for the gas is still roughly the same, and the ecological problem is not solved. Even though the propellant gas is not projected into the atmosphere during the use period of the container, the destruction of the container after it has been discarded ultimately releases the gas into the atmosphere. Aerosols, incidentally, are single-use devices, as there are no substantial salvage programs for them in general use at the time of the filing of this application. Pump devices are readily capable of re-use, and are commonly seen in conjunction with small containers of window-cleaning solution.

SUMMARY OF THE INVENTION

A dispenser assembly has an outer housing of a material and thickness providing substantial resilient deflection under manually-applied forces. A readily deformable inner container is surrounded by the housing, and holds the material to be dispensed. The inner container communicates with an outlet, and squeezing the outer housing generates an increase in the pressure of the air between the inner container and the outer housing, causing the inner housing to transmit this pressure to the contained flowable material. The resulting pressure ejects a quantity of the material through the outlet. Release of the gripping pressure permits the resilience of the outer housing to produce a degree of vacuum in the air space, and an air inlet in the outer housing permits air to flow in under this pressure differential. The amount of air will correspond exactly to the volume of the displaced material discharged at the outlet. The inlet opening in the housing is preferably covered by a finger of the user at a point clearly marked on the exterior surface. This system is usable with paste-like materials, as well as liquids. A simple form of construction of these dispensers includes the use of a tubular inner container of a thin film-like material of plastic or metal, and an outer housing of initially tubular configuration. Both the housing and the inner container are heat-sealable or closeable with a metal clip, and the assembly is closed off at the end opposite from the outlet by squeezing together both the housing and the inner container, and closing these components together along a common axis.

A modification of the invention establishes an additional use of the air pressure between the housing and inner container by providing jets adjacent the outlet for atomizing non-viscous liquids emerging from the inner container. In this form of the device, it may be desirable to use a check valve permitting inflow, exclusively, at the housing air inlet in order to prevent possible drainage out through this opening.

DESCRIPTION OF THE DRAWINGS

FIG. 1 is a perspective view of a dispenser of the approximate size and general configuration of a toothpaste tube.

FIG. 2 is an axial section of the device shown in FIG. 1 in its initial fully-loaded condition.

FIG. 3 is a view of the device shown in FIG. 2, with the contents of the inner container partially discharged.

FIG. 4 illustrates the dispenser in the condition in which the contents of the inner container are almost completely discharged.

FIG. 5 illustrates the manner in which the device shown in FIGS. 1–4 is used.

FIG. 23 is a section of the plane 23—23 of FIG. 24.

DESCRIPTION OF THE PREFERRED EMBODIMENTS

Figure 6:
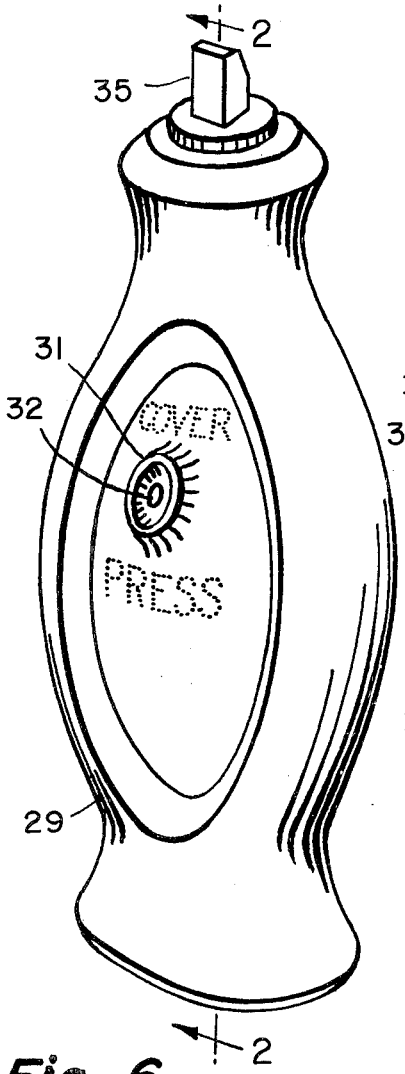
FIG. 6 illustrates a dispenser assembly more appropriate for low-viscosity liquids.

Referring to FIG. 1 through 5, the illustrated dispenser has an outer housing 20 of a material and thickness such that it is easily and resiliently deformable under manual pressure. The inner container 21 is preferably of a film-like consistency, and the materials of the inner container and the outer housing are preferably of a plastic capable of partial liquification under heat to produce a weld along lines of pressure. This characteristic of these materials is utilized in the initial assembly of the dispenser by bringing together the initially tubular configurations of the housing 20 and the inner container 21 along a line as shown at 22, where pressure and heat are applied to fuse these components together and seal them off at the end opposite from the discharge outlet 23. Where other materials are used, the closure can be effected by the use of conventional channel-shaped clips crimped shut to clamp the materials of the housing and inner container. The outer housing 20 is preferably molded with the end 24 forming an integral cap, and defining the discharge outlet through which the contents of the inner container 21 are discharged. The cap 24 may be threaded on its exterior for receiving a correspondingly threaded cover, if desired.

The outer housing 20 has an air inlet opening 25 communication with the air space between the housing and the inner container 21. The opening 25 is preferably surrounded by a surface configuration forming a depression (with the respect of the exterior surface of the housing) to define a particular spot for receiving the finger or thumb of the user, as shown in FIG. 5. As he squeezes the dispenser, with the opening 25 covered, the air pressure within the air space is communicated to the inner container so that the contents are discharged through the outlet 23. The specific configuration of the housing indicated at 26, to produce the surface discontinuity surrounding the area inlet 25, is of secondary importance. It is even conceivable that a raised area with an exteriorly-convex surface surrounding the discharge opening 25 might also give the necessary sense of orientation to the hand of the user to properly cover the air inlet 25 when pressure is being applied. The contents 27 of the inner container may vary through a wide range of viscosity from thin watery liquids to paste-like materials such as grease or toothpaste. Where thin liquids are used, it may be desirable to incorporate a check valve, as shown at 28, to inhibit drainage out of the device when pressure is not being applied.

Figure 7:
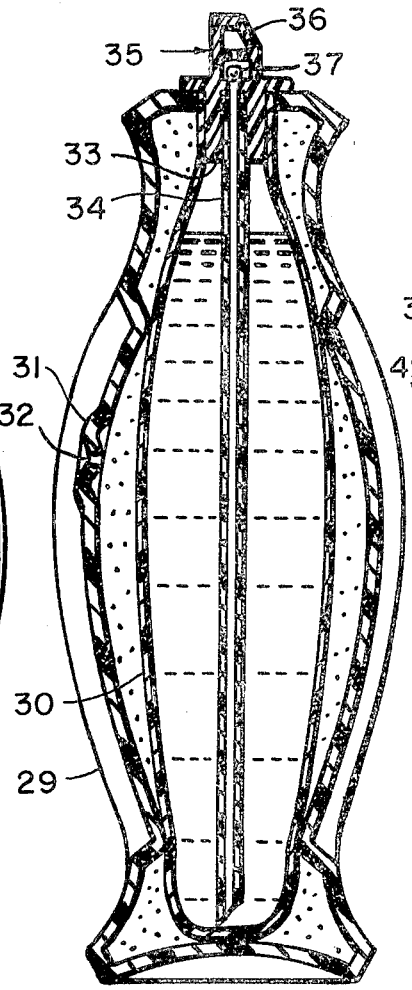
FIG. 7 is an axial section of the dispenser shown in FIG. 6, which the inner container substantially full.

The dispensers illustrated in FIG. 6–9 are more appropriate for low-viscosity liquids of a water consistency. The housing 29 and the inner container 30 are essentially similar to those described in connection with FIGS. 1 through 5. The localized configuration 31 on the housing defines a depression surrounding the air inlet 32. FIG. 7 shows a construction in which the inner container 30 may be heat-sealed to the housing at the top junction. The inner container is then filled, followed by the addition of the cap 33 carrying the tube 34, extending to a point adjacent the bottom of the inner container. The cap has a head 35 containing the jet orifice 36, and may also include a check valve 37.

Figure 8:
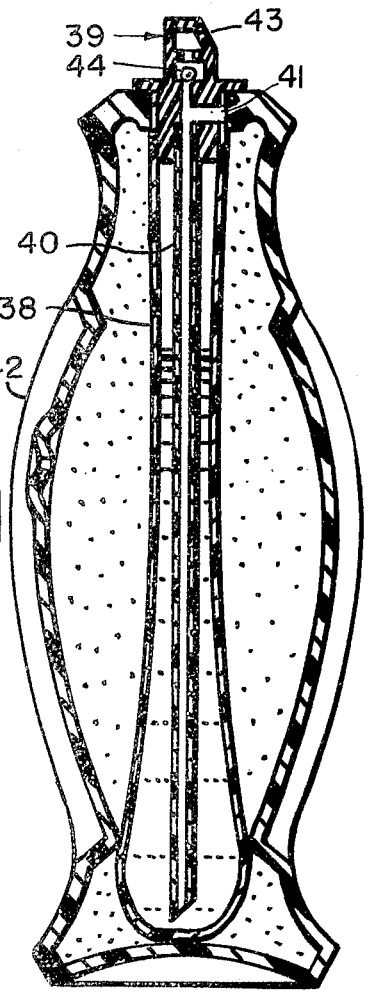
FIG. 8 is a view, similar to FIG. 7, of a modified form of the invention, with the inner dispenser almost empty.
Figure 9:
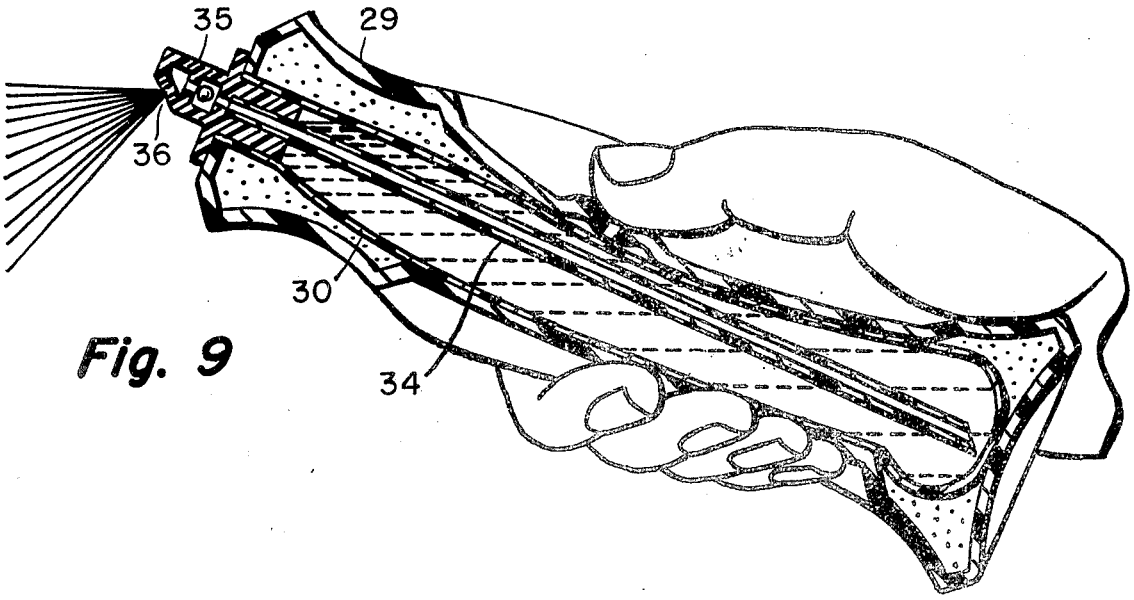
FIG. 9 is a sectional view along the axis of the device shown in FIG. 8, showing the manner in which it is used.
Figure 10:
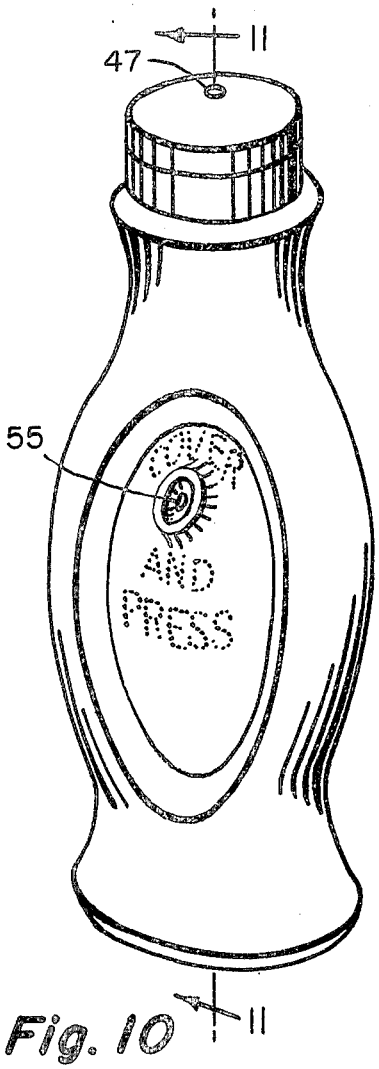
FIG. 10 is a perspective view of a modified form of the invention In which vaporizing air is used in addition to pressure ejection of the contained liquid.

In the modification shown in FIG. 8, the inner container 38, the cap 39, and the tube 40 form a subassembly that can be filled through the lateral opening 41 prior to the final seating of the cap 39 (when the opening 41 is above the top of the housing 42). The discharge outlet 43 and the check valve 44 are similar to the corresponding structure shown in FIG. 7.

Referring to FIGS. 10 through 13, the cap 45 forms a closure to the housing 46. The discharge outlet 47 in the cap receives liquid propelled upward through the tube 48, and also the air compressed by squeezing the housing. The liquid 49 is intermixed with this air as it passes through the outlet 47, which assists in atomizing the spray. The air moves from the space 50 between the inner container 51 and the housing 46 upwardly through the spaces between the radially-extending and angularly-spaced fins 52, and through the space between the cap 47 and the inner plug 53 of which the fins 52 are an integral part.

Droplets of liquid maY tend to accumulate just inside the outlet 47, and may then tend to drain back between the housing 54 and the inner container 51. If this accumulation becomes substantial, there may be a tendency for liquid to drain out through the air inlet 55, which is undesirable. This can be inhibited by either providing a flat flexible piece of material as indicated at 56, which is heat sealed to the inside of the container 57 to form a check valve permitting inflow (exclusively) into the container. The presence of this flap will obviously inhibit any tendency for the liquid to drain out through this opening. The configuration of the housing 54 at the base can also be designed as shown to inhibit any such undesirable drainage. The enlarged base portion 58 will tend to retain any small accumulations of liquid when the unit is placed on its side, which is the point at which the back drainage problem becomes critical. The back drainage can also be inhibited by accentuating the depression surrounding the area inlet 55, to the point that it becomes a pronounced peak on the interior of the housing.

Figure 14:
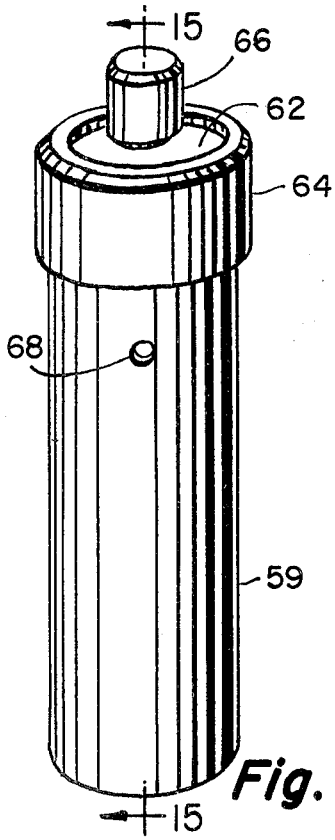
FIG. 14 is a perspective view of a modified form of the invention adapted for the marketing of replacement inner containers.
Figure 15:
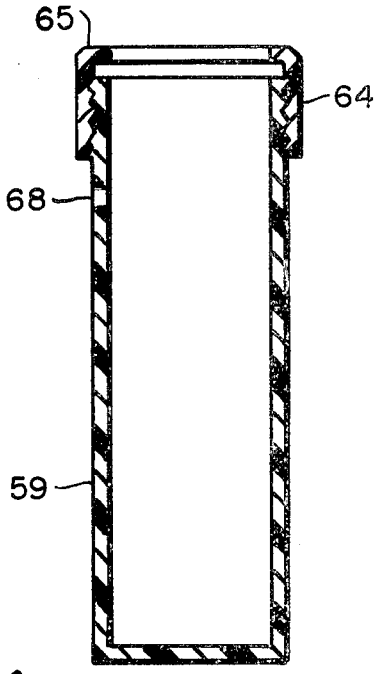
FIG. 15 is an axial section through the outer container of the unit shown in FIG. 14.
Figure 16:
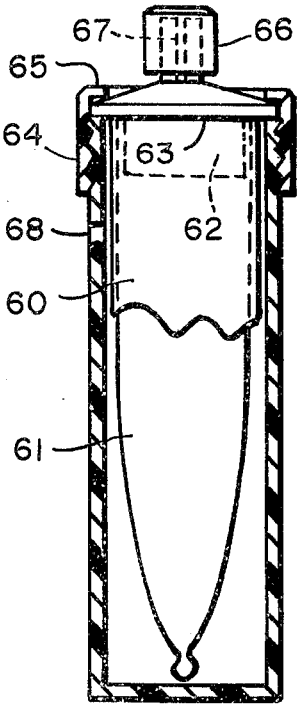
FIG. 16 is an axial section showing the assembly of the inner and outer containers in the FIG. 14 arrangement.

FIGS. 14 through 16 illustrate a modified form of The invention in which the outer container 59 receives a replaceable inner container 60. The assembly constituting the inner container 60 includes a film-like bag 61 and a closure head 62 provided with a peripheral flange 63. This flange is received across the open end of the housing 59, and is held in position by the ring 64 having the retaining flange 65. The cap 66 closes off the outlet 67 in the head 62, in the usual arrangement of a toothpaste tube. The housing 59 is provided with a vent hole 68, as in the previously-illustrated arrangements.

Figure 17:
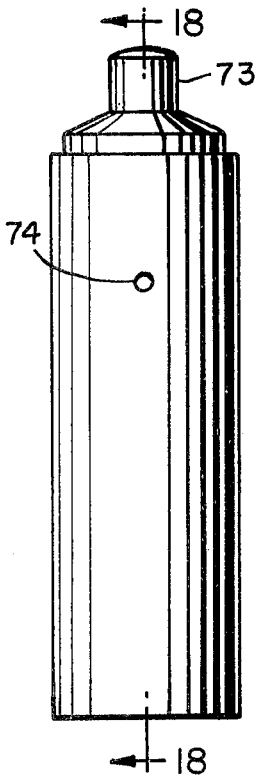
FIG. 17 is an elevation of a further modification of the invention.
Figure 18:
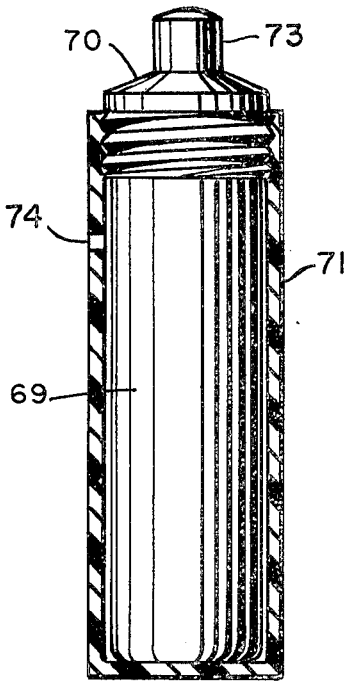
FIG. 18 is an axial section showing the assembly of the inner and outer containers of the FIG. 17 arrangement.
Figure 19:
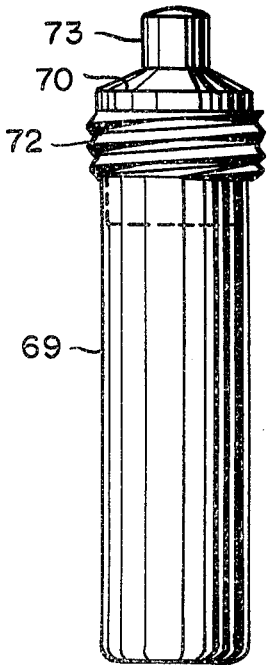
FIG. 19 is a view of the inner container in the form in which it would be marketed as a replacement.

FIGS. 17 through 19 illustrate a further modification, in which the inner container includes a bag 69 adhesively secured to the head 70 received within the outer housing 71. The head 70 has a threaded portion 72 for inter engagement with a correspondingly threaded portion on the housing. The cap 73 and the vent hole 74 are similar to those shown in FIGS. 14 through 16. In the modifications illustrated in FIGS. 14–16 and 17–19, the complete sealed inner container can be marketed as a replacement. Once the outer housing had been purchased, these replacements can be marketed somewhat more economically than would be the case if the outer housing were included in the assembly. This is particularly true when the outer housing is provided with extensive three dimensional contour. When the contents of the inner container are to be used by children, for example, this arrangement makes possible the marketing of doll-like objects functioning as the outer container, and also permits a much more varied inventory of the contents of the inner container, such as different colors, taste factors, and so forth without unnecessary duplication of the more expensive molded configurations of the outer housing.

Figure 20:
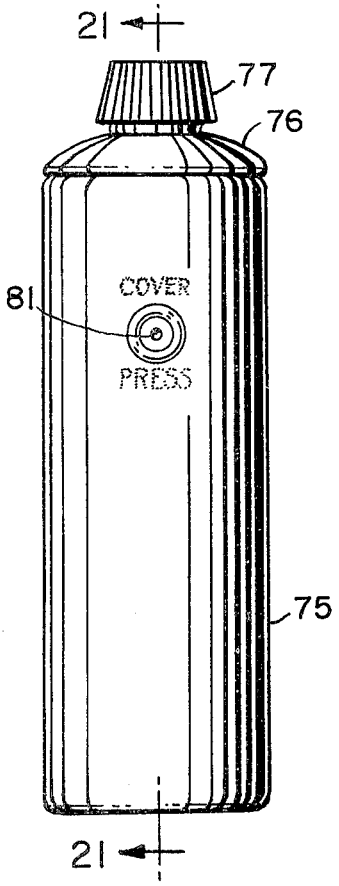
FIG. 20 is a side elevation of a modified form of the invention.
Figure 21:
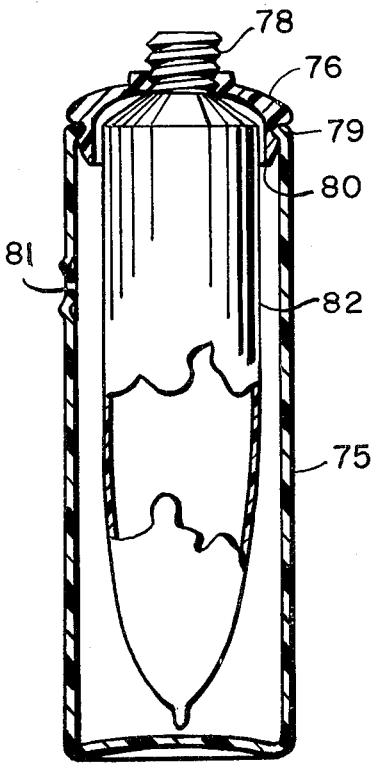
FIG. 21 is a section on the plane 21—21 of FIG. 20, showing the inner container partially in section.

Referring to FIGS. 20 and 21, the housing 75 has a cap 76, and the cover 77 is in threaded engagement with the end 78 of the inner container. The threaded portion 78 is also in threaded engagement with the cap 76. The housing 75 has an inwardly-turned flange 79 received in a corresponding groove in the cap 76. The configuration of the cap at 80 provides a wedging interengagement with the flange 79 on the assembly of the device to provide a snap-in retension of the flange 79. The materials of both the housing 75 and the cap 76 are readily deformable under manual pressure, and the cap can be disengaged from the flange 79 by simply pulling them free of each other. The housing 75 is provided with the air inlet 81, as in the previous modifications. This form of the invention is particularly adapted to the marketing of the inner containers 82 as a separate item. These can be packaged in a separate box in the manner of a toothpaste tube, preferably provided with either a cover 77 or with some form of easily-removeable temporary closure.

Figure 22:
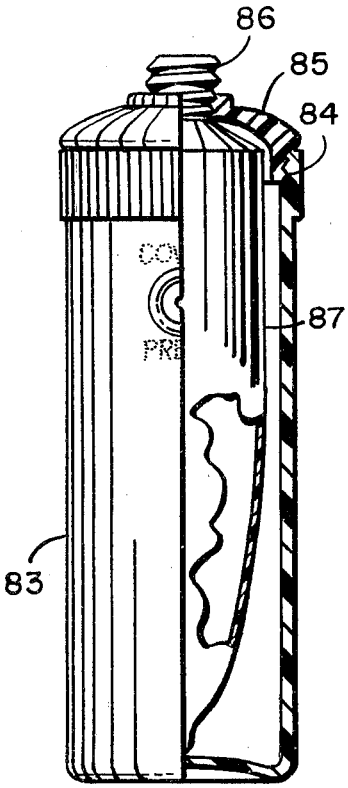
FIG. 22 is a partial sectional elevation of a further modification of the invention.

In the modification shown in FIG. 22, the housing 83 is similar to the housing 75, except for the provision of the threaded portion at 84 engaging the corresponding threaded portion of the cap 85. The threaded end 86 of the inner container 87 is in threaded engagement with the cap 85, as shown in FIG. 21, the inner containers 82 and 87 being substantially the same.

Figure 11:
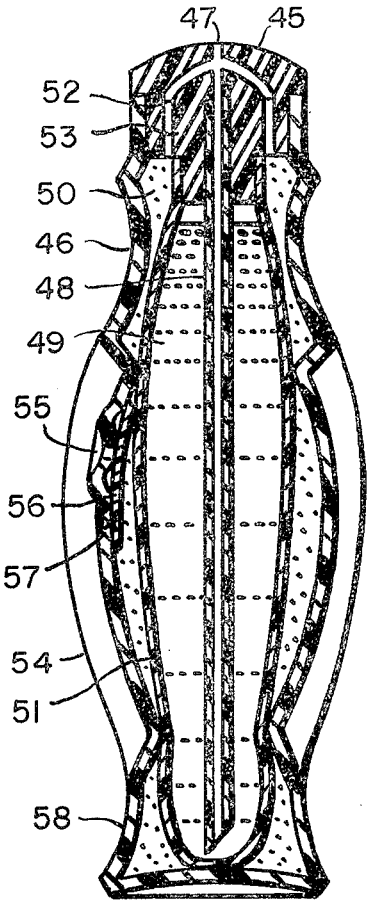
FIG. 11 is an axial section of the device shown in FIG. 10, with the inner container substantially full.
Figure 12:
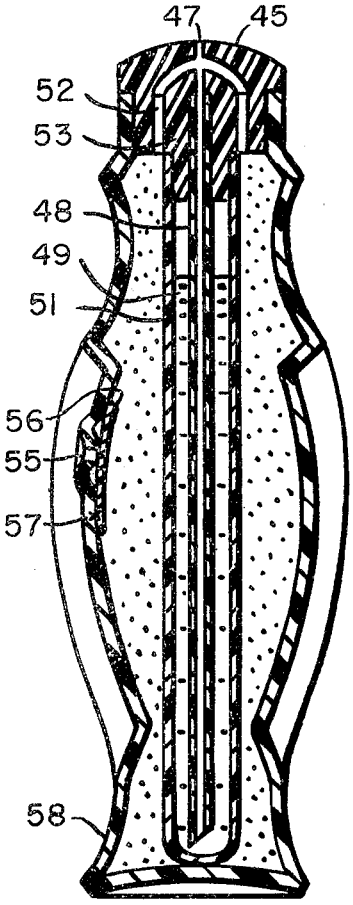
FIG. 12 is a view similar to FIG. 11, with the inner container almost empty.
Figure 13:
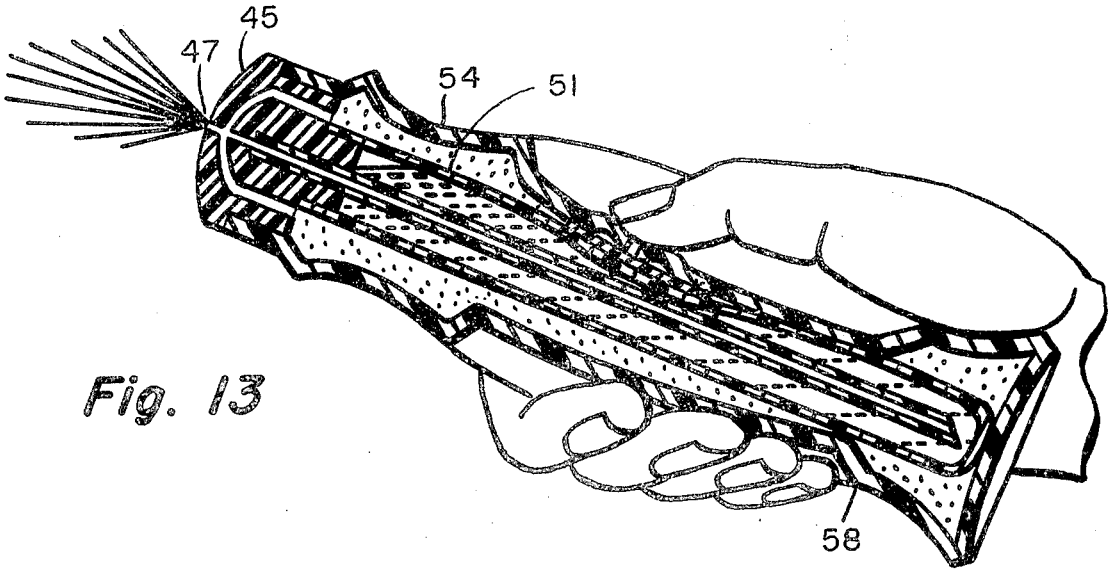
FIG. 13 is a view showing the manner in which the device shown on FIGS. 10–12 is used.
Figure 23:
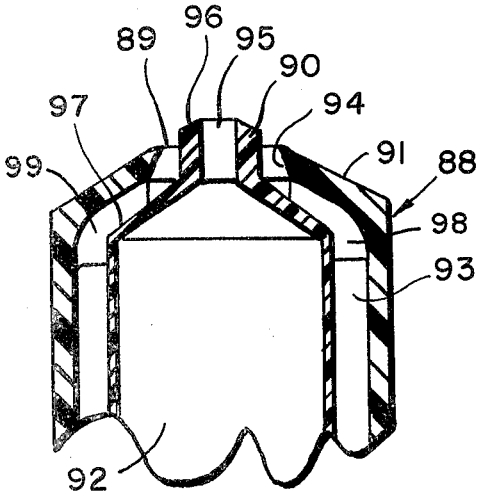
FIG. 23 is a partial axial section showing a form of atomization nozzle usable in conjunction with the FIGS. 10–13 modification.
Figure 24:
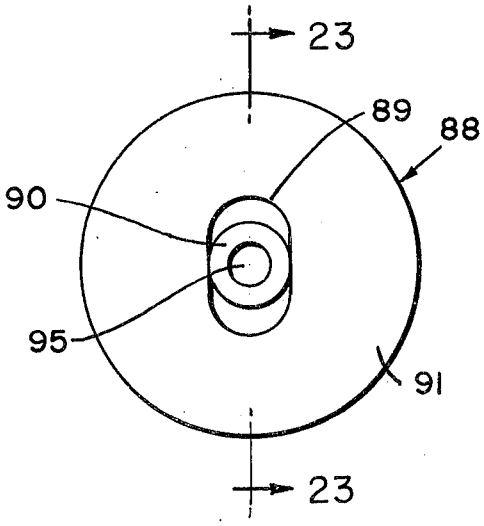
FIG. 24 is a top view of the modification shown in FIG. 23.

FIGS. 23 and 24 illustrate a form of nozzle configuration usable in conjunction with the forms of the invention shown in FIGS. 11 and 12. The exterior shell 88 of the nozzle assembly has an opening 89 receiving the tubular projection 90, which extends slightly beyond the generally conical top surface 91 of the shell. The chamber 92 either is, or forms a part of, the inner container of the assembly, which is discharged through the tubular projection 90. The chamber 93 is a continuation of the space between the inner container and the outer housing of the previously-described modifications, and the air compressed by manual pressure is forced through the opening 89 adjacent the projection 90. It is preferable that the opening 89 be defined by a beveled surface, as shown at 94, tending to direct the air jet at the axis of the material being emitted through the opening 95 in the projection 90. This effect is increased by also beveling the end of the projection 90, as shown at 96.

The amount of air discharged with each squeezing action can be adjusted within limits by relative axial displacement of the shell 88 with respect to the shoulder 97, which is a feature used in conjunction with various other types of nozzles. Where liquids of very low viscosity are used, it is often desirable to maintain a relationship between the cross sectional area of the opening 75 and that of the opening 89 in a ratio of approximately one to sixteen. The plan view configuration of the opening 89 may either by circular, to produce a uniform distribution of spray over a circular area, or may be elongated along one axis as shown in FIG. 24, to produce a fan-shaped spray. It should be noted that in either case, the extension of the tubular projection 95 beyond the surface 91 tends to cause the air jet to wipe the surface 96 (and the areas adjacent to it) free of accumulating droplets of liquid that might remain after the squeezing action is terminated. The relative placement of the tubular projection 90 within the opening 89 is maintained by angularly spaced fins as shown at 98 and 99 in FIG. 23, which can be integral with the shell 88.

A very extensive field of application for these inventions centers in the dispensing of air-drying, or air-cureable materials. The isolation of these materials from air by the use of the deformable inner container removes the tendency to suck air in to replace the volume of dispensed material. Plastics and sealing compounds are stored and dispensed very effectively with these devices. Closure covers for use with such materials will normally have a projection extending down into the inner container to keep the discharge passage free of solidified material. These cover projections are conventional in glue containers.

The dispensing of powdered materials can be handled by a modified form of the invention in which the inner container is resilient, and tends to return to its original configuration after distortion. This inner container would be partially filled with the powder to provide air space that can be subject to compression to induce a jet discharge which will carry some of the powder out with it. Supplementary air jets of the type shown in FIGS. 11-13 and 23 may be used to further break up masses of powder as they emerge. The plastic "memory" of the inner container will suck in air to replace the dispensed powder as the inner container tends to restore its original configuration. A cover of the type shown in FIG. 16 would normally be used.

I claim:

1. A dispenser for discharging a liquid in an atomized spray, comprising:

a housing formed of a material capable of substantial resilient deformation under manually applied forces, said housing being elongated and having a first opening at one end thereof and a second opening adapted to be sealingly covered by a finger of the user;

a container formed of a readily deformable material for holding said liquid, said container being elongated, having an opening at one end thereof, and receivable within said housing with said opening of said container being in close proximity to said first opening of said housing, and with said container extending the length of said housing; and a cap member having a first neck portion receivable within said first opening of said housing and adapted to have fluidtight connection with said housing and a second neck portion receivable within said opening of said container and adapted to have fluid-tight connection with said container, said cap member having a first port extending through said cap member and communicating with the interior of said container and at least one second port communicating with the portion of the interior of said housing external of said container, said second port terminating at a point closely adjacent the outer end of said first port whereby air discharged through said second port upon manual deformation of said housing atomizes the liquid discharged through said first port.

2. The dispenser of claim 1 further characterized in that said second port intersects said first port within said cap member.

3. The dispenser of claim 2 further characterized in that first and second ports intersect at a large acute angle.

4. The dispenser of claim 1 further characterized in that said second port terminates at the exterior of said cap member immediately adjacent the first port, the termination of said second port including a beveled surface for directing the air discharged through said second port into the liquid discharged through said first port at a point immediately adjacent the end of said first port.

* * * * *